US007212768B2

(12) United States Patent
Numagami et al.

(10) Patent No.: US 7,212,768 B2
(45) Date of Patent: May 1, 2007

(54) PROCESS CARTRIDGE AND ELECTROPHOTOGRAPHIC IMAGE FORMING APPARATUS

(75) Inventors: Atsushi Numagami, Hadano (JP); Shigeo Miyabe, Numazu (JP); Shinjiro Toba, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 217 days.

(21) Appl. No.: 10/960,088

(22) Filed: Oct. 8, 2004

(65) Prior Publication Data

US 2006/0072936 A1 Apr. 6, 2006

(30) Foreign Application Priority Data

Oct. 6, 2004 (JP) ..... 2004-293846

(51) Int. Cl.
*G03G 21/16* (2006.01)

(52) U.S. Cl. ..... 399/111

(58) Field of Classification Search ..... 399/111, 399/107, 167

See application file for complete search history.

(56) References Cited

U.S. PATENT DOCUMENTS 5,331,373 A 7/1994 Nomura et al.
5,452,056 A 9/1995 Nomura et al.
5,500,714 A 3/1996 Yashiro et al.
5,543,898 A 8/1996 Shishido et al.
5,585,889 A 12/1996 Shishido et al.
5,585,895 A 12/1996 Yashiro et al.
5,617,579 A 4/1997 Yashiro et al. ..... 399/114
5,689,774 A 11/1997 Shishido et al. ..... 399/111
5,790,923 A 8/1998 Oguma et al. ..... 399/106
5,839,028 A 11/1998 Nomura et al. ..... 399/109
5,873,012 A 2/1999 Miyabe et al. ..... 399/90
5,878,309 A 3/1999 Nomura et al. ..... 399/111
5,878,310 A 3/1999 Noda et al. ..... 399/117
5,920,753 A 7/1999 Sasaki et al. ..... 399/111

(Continued)

FOREIGN PATENT DOCUMENTS

EP 1 359 474 A1 11/2003

(Continued)

OTHER PUBLICATIONS

Pending U.S. Appl. No. 10/960.077, filed Oct. 8, 2004, Masaaki Sato et al.

(Continued)

*Primary Examiner*—Susan Lee
(74) *Attorney, Agent, or Firm*—Fitzpatrick, Cella, Harper & Scinto

(57) ABSTRACT

A process cartridge detachably mountable to an electrophotographic image forming includes an electrophotographic photosensitive drum; a developing roller; a first cartridge positioning portion abuttable to a first main assembly positioning portion provided in a main assembly of the apparatus to position the cartridge with respect to a direction crossing the longitudinal direction, when the cartridge is mounted to the main assembly; a second cartridge positioning portion abuttable to a second main assembly positioning portion provided in the main assembly to limit rotation of the cartridge about the first cartridge positioning portion, when the cartridge receives a rotational driving force for rotating the roller from the main assembly; and a first drive input gear, for engagement with a main assembly driving gear to transmit a rotational driving force to the roller.

13 Claims, 15 Drawing Sheets

U.S. PATENT DOCUMENTS

| | | | | |
|---|---|---|---|---|
| 5,926,666 | A | 7/1999 | Miura et al. | 399/25 |
| 5,937,239 | A | 8/1999 | Watanabe et al. | 399/111 |
| 5,937,242 | A | 8/1999 | Yokoyama et al. | 399/114 |
| 5,943,529 | A | 8/1999 | Miyabe et al. | 399/111 |
| 5,946,531 | A | 8/1999 | Miura et al. | 399/111 |
| 5,950,047 | A | 9/1999 | Miyabe et al. | 399/111 |
| 5,966,566 | A | 10/1999 | Odagawa et al. | 399/109 |
| 5,966,567 | A | 10/1999 | Matsuzaki et al. | 399/111 |
| 5,966,568 | A | 10/1999 | Numagami et al. | 399/111 |
| 6,006,058 | A | 12/1999 | Watanabe et al. | 399/167 |
| 6,016,413 | A | 1/2000 | Yokoyama et al. | 399/113 |
| 6,029,031 | A | 2/2000 | Yokomori et al. | 399/109 |
| 6,029,032 | A | 2/2000 | Watanabe et al. | 399/111 |
| 6,064,843 | A | 5/2000 | Isobe et al. | 399/111 |
| 6,072,968 | A | 6/2000 | Nomura et al. | 399/113 |
| 6,097,909 | A | 8/2000 | Watanabe et al. | 399/111 |
| 6,101,354 | A | 8/2000 | Nakagawa et al. | 399/225 |
| 6,118,960 | A | 9/2000 | Nakagawa et al. | 399/111 |
| 6,128,452 | A | 10/2000 | Miyabe et al. | 399/90 |
| 6,154,623 | A | 11/2000 | Suzuki et al. | 399/111 |
| 6,169,866 | B1 | 1/2001 | Watanabe et al. | 399/111 |
| 6,173,140 | B1 | 1/2001 | Suzuki et al. | 399/113 |
| 6,215,969 | B1 | 4/2001 | Nomura et al. | 399/111 |
| 6,236,821 | B1 | 5/2001 | Yokoyama et al. | 399/113 |
| 6,246,849 | B1 | 6/2001 | Yokoyama et al. | 399/117 |
| 6,266,500 | B1 | 7/2001 | Numagami et al. | 399/104 |
| 6,272,299 | B1 | 8/2001 | Numagami et al. | 399/111 |
| 6,282,390 | B1 | 8/2001 | Miyabe et al. | 399/111 |
| 6,289,189 | B1 | 9/2001 | Numagami et al. | 399/111 |
| 6,317,572 | B1 | 11/2001 | Miyabe et al. | 399/111 |
| 6,330,409 | B1 | 12/2001 | Watanabe et al. | 399/111 |
| 6,336,017 | B1 | 1/2002 | Miyamoto et al. | 399/116 |
| 6,351,620 | B1 | 2/2002 | Miyabe et al. | 399/111 |
| 6,424,811 | B1 | 7/2002 | Tsuda et al. | 399/167 |
| 6,442,359 | B1 | 8/2002 | Numagami et al. | 399/111 |
| 6,463,233 | B2 | 10/2002 | Kojima et al. | 399/111 |
| 6,519,431 | B1 | 2/2003 | Toba et al. | 399/111 |
| 6,542,706 | B2 | 4/2003 | Toba et al. | 399/111 |
| 6,549,736 | B2 | 4/2003 | Miyabe et al. | 399/111 |
| 6,577,831 | B1 | 6/2003 | Kojima et al. | 399/111 |
| 6,603,939 | B1 | 8/2003 | Toba et al. | 399/103 |
| 6,608,980 | B2 | 8/2003 | Murayama et al. | 399/111 |
| 6,678,488 | B2 | 1/2004 | Toba et al. | 399/111 |
| 6,684,041 | B2 | 1/2004 | Yokomori et al. | 399/167 |
| 6,714,750 | B2 | 3/2004 | Terada et al. | 399/111 |
| 6,714,752 | B2 | 3/2004 | Ueno et al. | 399/117 |
| 6,795,666 | B2 | 9/2004 | Miyabe et al. | 399/109 |
| 6,829,455 | B2 | 12/2004 | Yasumoto et al. | 399/167 |
| 6,836,629 | B2 | 12/2004 | Miyabe et al. | 399/111 |
| 6,968,142 | B2 * | 11/2005 | Arimitsu et al. | 399/111 |
| 7,027,754 | B2 | 4/2006 | Harada et al. | 399/111 |
| 2002/0085854 | A1 | 7/2002 | Numagami et al. | 399/90 |
| 2002/0110385 | A1 | 8/2002 | Terada et al. | 399/111 |
| 2002/0110388 | A1 | 8/2002 | Yokomori et al. | 399/167 |
| 2002/0159787 | A1 | 10/2002 | Chadani et al. | 399/109 |
| 2002/0191981 | A1 | 12/2002 | Miyabe et al. | 399/90 |
| 2003/0142994 | A1 | 7/2003 | Harada et al. | 399/111 |
| 2006/0147225 | A1 | 7/2006 | Harada et al. | 399/111 |

FOREIGN PATENT DOCUMENTS

| | | |
|---|---|---|
| JP | 55-15177 | 2/1980 |
| JP | 10-187005 | 7/1998 |
| JP | 2003-208075 | 7/2003 |
| KR | 2002-0064667 | 8/2002 |
| KR | 10-0448183 | 9/2004 |

OTHER PUBLICATIONS

Korean Office Action in Appln. No. 2006-017687269.
Nov. 21, 2006 Japanese Office Action in Japanese Application No. 2004-293846.

* cited by examiner (a)

(b)

(a)

(b)

(a)

(b)

PROCESS CARTRIDGE AND ELECTROPHOTOGRAPHIC IMAGE FORMING APPARATUS

FIELD OF THE INVENTION AND RELATED ART

The present invention relates to a process cartridge and an electrophotographic image forming apparatus.

The electrophotographic image forming apparatus forms an image on a recording material through an electrophotographic image formation type process. The electrophotographic image forming apparatus may be an electrophotographic copying machine, an electrophotographic printer (an LED printer, a laser beam printer or the like), an electrophotographic printer type facsimile machine, an electrophotographic printer type word processor or the like.

In the field of an electrophotographic image forming apparatus using an electrophotographic image process, a process cartridge type is known in which an electrophotographic photosensitive member, i.e., an electrophotographic photosensitive drum and process means actable on the electrophotographic photosensitive drum are integrally contained in a cartridge which is detachably mountable to a main assembly of an electrophotographic image forming apparatus as a unit. Such a process cartridge type is advantageous in that a maintenance operation of the apparatus can be performed by the user without relying on a serviceman, and therefore, the operability is good. Therefore, the process cartridge type is widely used in the field of image forming apparatus.

In an electrophotographic image forming apparatus, the light corresponding to image information is projected from a laser, an LED or a lamp onto an electrophotographic photosensitive drum (photosensitive drum). This forms an electrostatic latent image on the photosensitive drum. The electrostatic latent image thus produced is developed by a developing member which is built into the process cartridge. The developed image formed on the photosensitive drum is transferred onto the recording is material. In this manner, an image is formed on a recording material.

In a conventional example, a developing device includes a developing roller swingably supported on a supporting shaft provided in the main assembly of the image forming apparatus, and a follow gear for transmitting the driving to the developing roller (Japanese Laid-open Patent Application Sho 55-15177). The follow gear is rotatably supported on an outside of a side plate supporting the developing roller, and it is brought into meshing engagement with a driving gear provided in the main assembly of the image forming apparatus to transmit the driving force. The developing device is correctly positioned relative to the main assembly of the image forming apparatus by the side plate abutting to a stopper provided in the main assembly of the image forming apparatus. With this arrangement, the position where the driving force is transmitted to the follow gear and the position where the side plate is abutted to the stopper are different in the longitudinal direction of the developing device. Therefore, when the driving is transmitted from the driving gear, the developing device is subjected to a moment about the position where the side plate is abutted to the stopper with respect to the longitudinal direction of the developing device. There is a possibility that the moment adversely affects the positional accuracy of the developing roller and so on.

SUMMARY OF THE INVENTION

Accordingly, it is a principal object of the present invention to provide a process cartridge and an electrophotographic image forming apparatus, in which the process cartridge is subjected to less bending moment and less deformation thereof when the process cartridge set in place in the main assembly of the electrophotographic image forming apparatus and receives the driving force from the main assembly of the apparatus.

It is another object of the present invention to provide a process cartridge and an electrophotographic image forming apparatus in which the deformation of the process cartridge is suppressed, the deformation being otherwise caused by the force received by the driving input gear within the engagement range between the driving input gear and the main assembly driving gear when the process cartridge set in place in the main assembly of the electrophotographic image forming apparatus and receives the driving force from the main assembly of the apparatus.

It is a further object of the present invention to provide a developing cartridge, a process cartridge and an electrophotographic image forming apparatus in which even when the rotational driving force is transmitted from the main assembly of the electrophotographic image forming apparatus, the developing roller is kept positioned with high accuracy relative to the main assembly of the apparatus.

It is a further object of the present invention to provide a developing cartridge, a process cartridge and an electrophotographic image forming apparatus which are downsized.

According to an aspect of the present invention, there is provided a process cartridge detachably mountable to an electrophotographic image forming apparatus, the process cartridge comprising an electrophotographic photosensitive drum extending in a longitudinal direction of the process cartridge; a developing roller for developing an electrostatic latent image formed on the electrophotographic photosensitive drum; a first cartridge positioning portion which is provided at each of one and the other longitudinal end portion of the process cartridge and which is abuttable to a first main assembly positioning portion provided in the main assembly of the apparatus to position the process cartridge with respect to a direction crossing the longitudinal direction, when the process cartridge is mounted to the main assembly of the apparatus; a second cartridge positioning portion which is provided at one longitudinal end portion of the process cartridge and which is abuttable to a second main assembly positioning portion provided in the main assembly of the apparatus to limit rotation of the process cartridge about the first cartridge positioning portion, when the process cartridge receives a rotational driving force for rotating the developing roller from the main assembly of the apparatus; and a first drive input gear, provided at the one longitudinal end portion, for engagement with a main assembly driving gear provided in the main assembly to transmit a rotational driving force to the developing roller the range of engagement, with respect to the longitudinal direction, between the main assembly driving gear and the input gear when the input gear is engaged with the main assembly gear, overlaps with the second cartridge positioning portion as seen in a direction which is perpendicular to the longitudinal direction and which passes through the second cartridge positioning portion.

According to another aspect of the present invention, there is provided an electrophotographic image forming apparatus for forming an image on a recording material, to which a process cartridge is detachably mountable, The apparatus comprises (a) a first main assembly positioning portion; (b) a second main assembly positioning portion; (c) a main assembly driving gear; and (d) a mounting means for detachably mounting a process cartridge. The process cartridge includes: an electrophotographic photosensitive drum extending in a longitudinal direction of the process cartridge; a developing roller for developing an electrostatic latent image formed on the electrophotographic photosensitive drum; a first cartridge positioning portion which is provided at each of one and the other longitudinal end portion of the process cartridge and which is abuttable to the first main assembly positioning portion provided in the main assembly of the apparatus to position the process cartridge with respect to a direction crossing the longitudinal direction, when the process cartridge is mounted to the main assembly of the apparatus; a second cartridge positioning portion which is provided at one longitudinal end portion of the process cartridge and which is abuttable to the second main assembly positioning portion provided in the main assembly of the apparatus to limit rotation of the process cartridge about the first cartridge positioning portion, when the process cartridge receives a rotational driving force for rotating the developing roller from the main assembly of the apparatus; and a first drive input gear, provided at the one longitudinal end portion, for engagement with a main assembly driving gear provided in the main assembly to transmit a rotational driving force to the developing roller. The range of engagement, with respect to the longitudinal direction, between the main assembly driving gear and the first drive input gear when the first drive input gear is engaged with the main assembly gear, overlaps with the second cartridge positioning portion as seen in a direction which is perpendicular to the longitudinal direction and which passes through the second cartridge positioning portion. The apparatus further comprises (e) feeding means for feeding the recording material.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First Embodiment

A description will be provided as to a developing unit, a process cartridge and an electrophotographic image forming apparatus according to an embodiment of the present invention.

(General Arrangement of Image Forming Apparatus)

Figure 1:
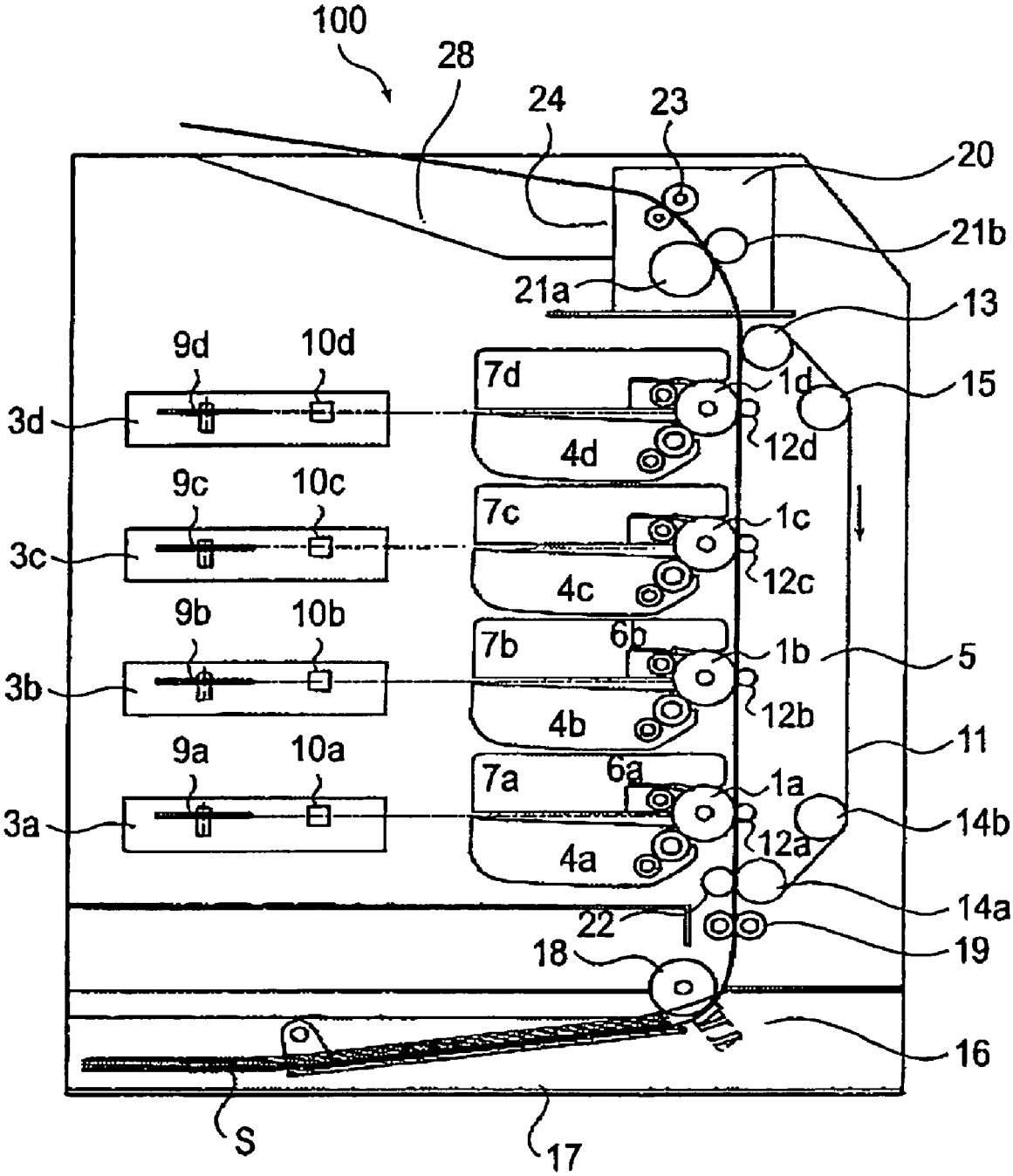
FIG. 1 is a sectional view of an example of a multi-color image forming apparatus according to an embodiment of the present invention.

Referring to FIG. 1, a description will first be provided as to the general arrangement of the multi-color image forming apparatus. FIG. 1 is a longitudinal sectional view illustrating a general arrangement of a full-color laser beam printer 100 which is an example of a multi-color image forming apparatus.

The multi-color image forming apparatus 100 shown in this figure includes four photosensitive drums 1*a*, 1*b*, 1*c*, 1*d* which are arranged substantially vertically. The photosensitive drum 1 is rotated in the counterclockwise direction in the figure by a driving means (unshown). Around the photosensitive drum 1, there are provided charging means 2 for electrically charging the associated photosensitive drum 1 to a uniform potential, a scanner unit (3*a*, 3*b*, 3*c*, 3*d*) for forming an electrostatic latent image on the photosensitive drum 1 by exposing it with a laser beam modulated in accordance with image information, and a developing unit 4 (4*a*, 4*b*, 4*c*, 4*d*) for developing the electrostatic latent image with a developer, electrostatic transferring means 5 for transferring the toner image provided by the development from the photosensitive drum 1 onto a recording material S, and cleaning means (6*a*, 6*b*, 6*c*, 6*d*) for removing untransferred toner remaining on the surface of the photosensitive drum 1 after the image transfer, in the order named.

In this embodiment, the photosensitive drum 1, the charging means 2, the developing unit 4, and the cleaning means are contained in a cartridge 7 (7*a*–7*d*) as a unit.

Figure 2:
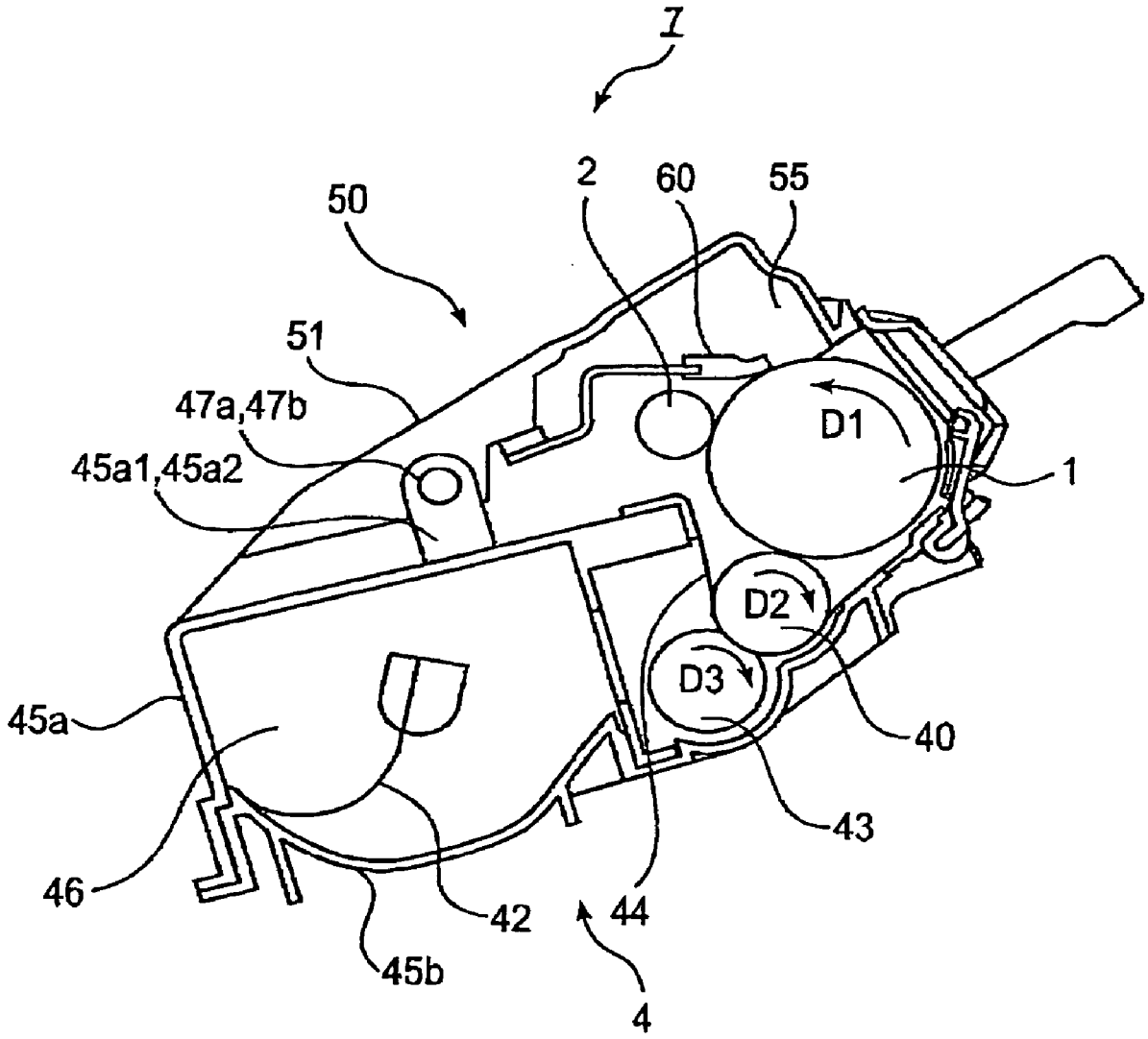
FIG. 2 is a main sectional view of a process cartridge according to an embodiment of the present invention.
Figure 3:
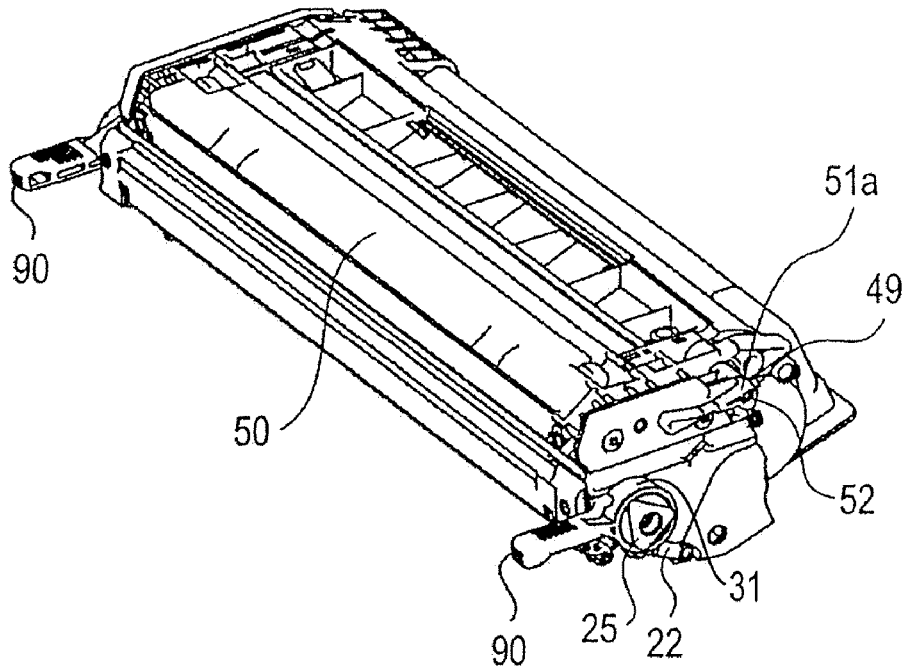
FIGS. 3(*a*) and 3(*b*) are perspective views of a process cartridge according to an embodiment of the present invention.
Figure 3:
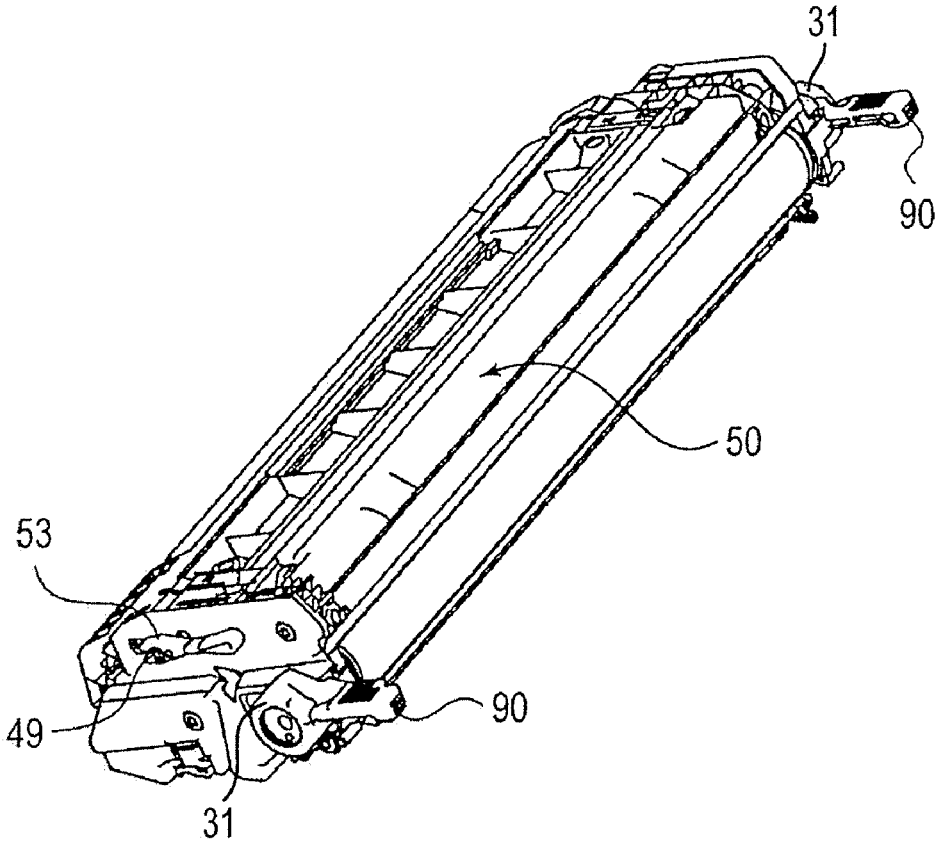

The photosensitive drum 1 has a photosensitive layer on an outer surface of an aluminum cylinder, for example. The photosensitive drum 1 is rotatably supported on a cleaning frame 51 (first frame) by end supporting members (unshown) at the opposite ends. At one axial end of the photosensitive drum 1 (longitudinal end of the cartridge 7), there is provided a coupling member 25 mounted thereto as shown in FIG. 3. A driving force is transmitted from a driving motor (unshown) to the coupling member 25 through a main assembly coupling (unshown). As shown in FIG. 2, the photosensitive drum 1 is rotated in the counterclockwise direction as indicated by arrow D1.

In this embodiment, a contact charging type charging means 2 is used. The charging means 2 is in the form of an electroconductive roller, which is contacted to the peripheral surface of the photosensitive drum 1. The roller 2 is supplied with a charging bias voltage. By this, the peripheral surface of the photosensitive drum 1 is uniformly charged. In this embodiment, the use is made of reverse development, and therefore, the peripheral surface of the photosensitive drum 1 is charged to a negative polarity.

The scanner unit (3*a*, 3*b*, 3*c*, 3*d*) is disposed substantially at the same levels as the associated photosensitive drum 1 and is extended substantially in a horizontal direction. The image light produced by a laser diode (unshown) correspondingly to an image signal is projected onto one of polygonal mirrors 9(*a*)–9(*d*), which are rotated at a high speed by a scanner motor (unshown). The image light reflected by the polygonal mirror is projected on the surface of the photosensitive drum 1 which has been electrically charged, through one of imaging lenses (10*a*, 10*b*, 10*c*, 10*d*). By the imagewise exposure of the photosensitive drum to the image light, an electrostatic latent image is formed in accordance with the image signal.

As shown in FIG. 2, the developing units 4 (4*a*, 4*b*, 4*c*, 4*d*) contain yellow color, magenta color, cyan color and black color developers (toner particles) in respective toner containers. The toner is supplied to an associated toner supplying roller 43 by a toner feeding mechanism 42 provided in the toner accommodating container 46. The toner supplying roller 43 rotates in the clockwise direction (arrow D3 direction) in the figure to supply the toner to the developing roller 40, which effects the development of the photosensitive drum 1. The toner supplying roller 43 removes the toner from the developing roller 40 after the development. Then, the toner supplied to the developing roller 40 is applied on the outer surface of the developing roller 40 which is rotating in the clockwise direction in the figure, by a developing blade 44 press-contacted to the outer surface of the developing roller 40. The developing roller 40 is supplied with a developing bias voltage to develop the latent image on the photosensitive drum 1 into a toner image. The rotational axis of the developing roller 40 is parallel with the axis of the photosensitive drum 1.

On the other hand, as shown in FIG. 1, the image forming apparatus 100 includes an electrostatic transfer belt 11 which makes a circulation movement by all of the photosensitive drums 1*a*–1*d*. The transfer belt 11 is an electrostatic conveyer belt made of resin film, a multi-layer film having a rubber base layer and a resin material layer thereon. While the belt 11 circulates, it electrostatically attracts the recording material S on the outer surface at the left side in FIG. 1 and contacts the recording material S to the photosensitive drum 1. The recording material S is fed to the image transfer station by the transfer belt 11, where the toner image is transferred from the photosensitive drum 1 onto the recording material S.

Transfer rollers (12*a*, 12*b*, 12*c*, 12*d*) are disposed in the electrostatic transfer belt 11 which is an endless belt, and are contacted to the inside of the electrostatic transfer belt 11 at a position opposed to their associated photosensitive drum (1*a*, 1*b*, 1*c*, 1*d*). The transfer rollers apply charge of a positive polarity to the recording material S through the electrostatic transfer belt 11. By this, the toner image is transferred from the photosensitive drum 1 onto the recording material S.

A feeding portion 16 functions to feed the recording material S to such an image forming station. Here, a cassette 17 accommodates a plurality of recording materials S. During the image forming operation, a paper feeding roller 18 (crescent roller) and registration roller 19 are rotated in accordance with the image forming operation. By this, the recording material S in the cassette 17 is fed out one by one. A leading end of the recording material S is abutted to the registration roller 19, and temporarily stops to form a loop. The recording material S is fed to the electrostatic transfer belt 11 in timed relation with the rotation of the electrostatic transfer belt 11 and the image writing position by the registration roller 19.

The fixing portion 20 functions to fix the toner images of different colors having been transferred onto the recording material S. The fixing portion 20 includes a rotatable heating roller 21*a* and a pressing roller 21*b* press-contacted thereto to apply heat and pressure to the recording material S. The recording material S having the toner image transferred from the photosensitive drum 1, is fed by the pressing roller 21*b* in the nip of the fixing portion 20, provided by the heating and pressing rollers 21*a* and 21*b*. In the fixing portion 20, the recording material is pressed and heated by the pressing roller 21*b* and the heating roller 21*a*. By doing so, the toner image comprising toner particles having a plurality of colors is fixed on the surface of the recording material S.

The image forming operation is as follows.

The cartridges 7*a*, 7*b*, 7*c*, 7*d* are sequentially rotated in timed relation with the image forming operation. By this, the photosensitive drums (1*a*, 1*b*, 1*c*, 1*d*) are rotated in response thereto. The scanner unit is sequentially actuated corresponding to the cartridges. By the actuation, the charging roller 2 applies uniform charge on the peripheral surface of the photosensitive drum 1. The scanner unit exposes the peripheral surface of the photosensitive drum 1 in accordance with image signal to form an electrostatic latent image on the peripheral surface of the photosensitive drum 1. The developing roller 40 in the developing unit 4 transfers the toner to a low potential portion of the electrostatic latent image, thus forming a toner image on the peripheral surface of the photosensitive drum 1.

As described in the foregoing, the toner image is sequentially transferred from the photosensitive drums 1 onto the recording material S by the electric fields formed between the photosensitive drums 1 and the transfer rollers.

The recording material S onto which the toner image has been transferred, is separated from electrostatic transfer belt 11 by the belt driving roller 13 using the curvature of the belt driving roller 13, and is fed into the fixing portion 20. The recording material S is subjected to the heat fixing operation of the fixing portion 20 so that the toner image is fixed, and then is discharged from a discharging portion 24 onto the tray 28 with the image side facing down.

(Structure of Process Cartridge)

Referring to FIGS. 2 and 3, a description will be provided in detail as to the process cartridge (cartridge) according to an embodiment of the present invention. FIGS. 2 and 3 are a main section and a perspective view of the cartridge 7 accommodating the developer. The cartridges 7*a*, 7*b*, 7*c*, 7*d* for yellow color, magenta color, cyan color and black color have substantially or exactly the same structure. The cartridge 7 comprises a cleaner unit 50 containing the electrophotographic photosensitive drum 1, the charging means and the cleaning means, and a developing unit 4 containing the developing roller for developing the electrostatic latent image on the photosensitive drum 1.

In the cleaner unit 50, the photosensitive drum 1 is rotatably mounted to the cleaning frame 51 (first frame) through bearing members 31 (first cartridge positioning portion). The photosensitive drum 1 has a photosensitive layer on the outer surface thereof. Around the photosensitive drum 1, there are provided a charging means 2 for electrically charging the photosensitive layer to a uniform potential, a cleaning blade 60 for removing the toner remaining on the photosensitive drum 1 after the image transfer, and a flexible sheet. The charging means 2, the cleaning blade 60 and the flexible sheet are supported by the cleaning frame 51. The toner removed from the surface of the photosensitive drum 1 by the cleaning blade 60 is sequentially fed to a residual toner chamber 55 provided at a rear side of the cleaning frame 51.

The developing unit 4 contains a developing roller 40 rotating with a small gap from the photosensitive drum 1 and a developing device frame 45 (second frame). The developing roller 40 is rotatable in the direction indicated by arrow D2.

The developing device frame 45 comprises an upper frame 45*a* and a lower frame member 45*b*. The upper frame 45*a* and the lower frame member 45*b* are welded by ultrasonic welding to constitute a toner accommodating portion 46 for accommodating the toner. The developing roller 40 is rotatably supported by the developing device frame 45 through bearing members (unshown).

To the developing roller 40, the toner supplying roller 43 and the developing blade 44 are contacted. The toner supplying roller 43 is rotatable in the direction indicated by arrow D3. In the toner accommodating container 46, there is provided a toner feeding mechanism 42 for stirring and feeding the toner to the toner supplying roller 43.

Figure 8:
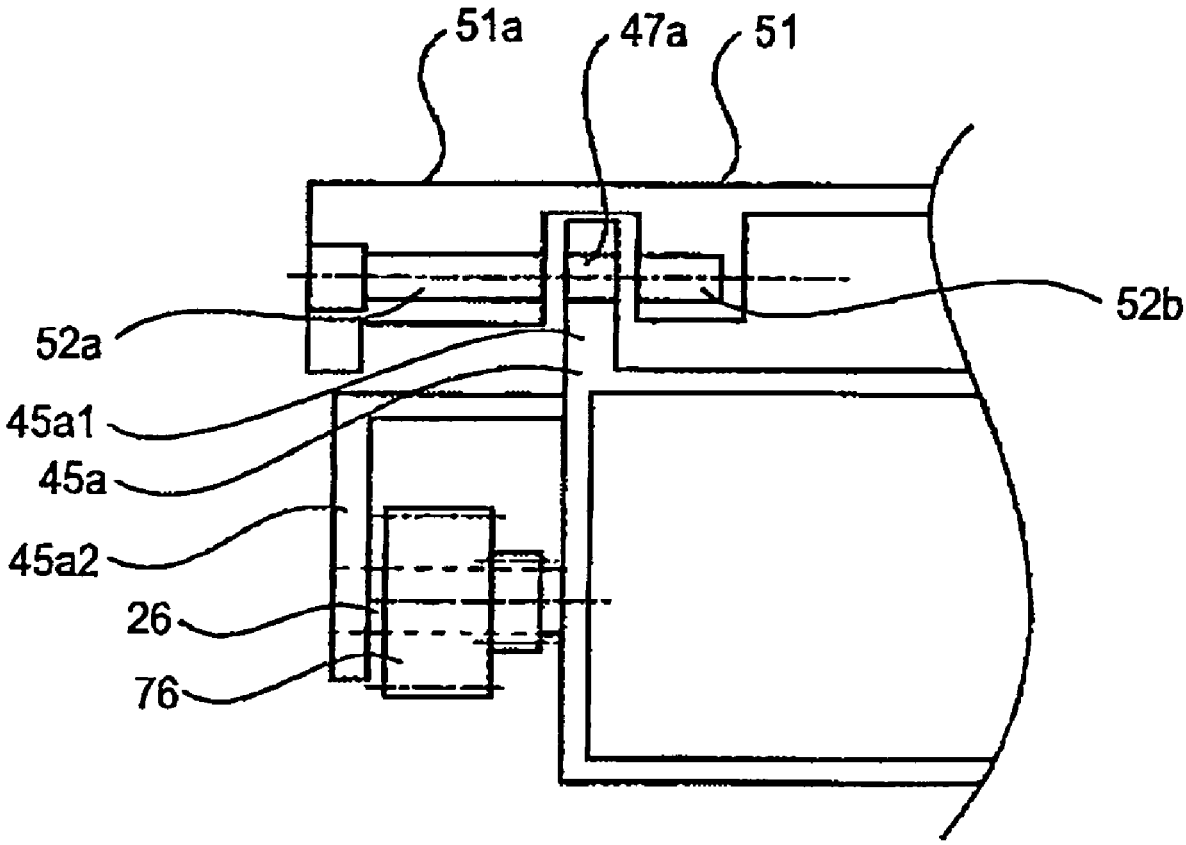
FIG. 8 is a sectional view of a process cartridge according to an embodiment of the present invention.
Figure 9:
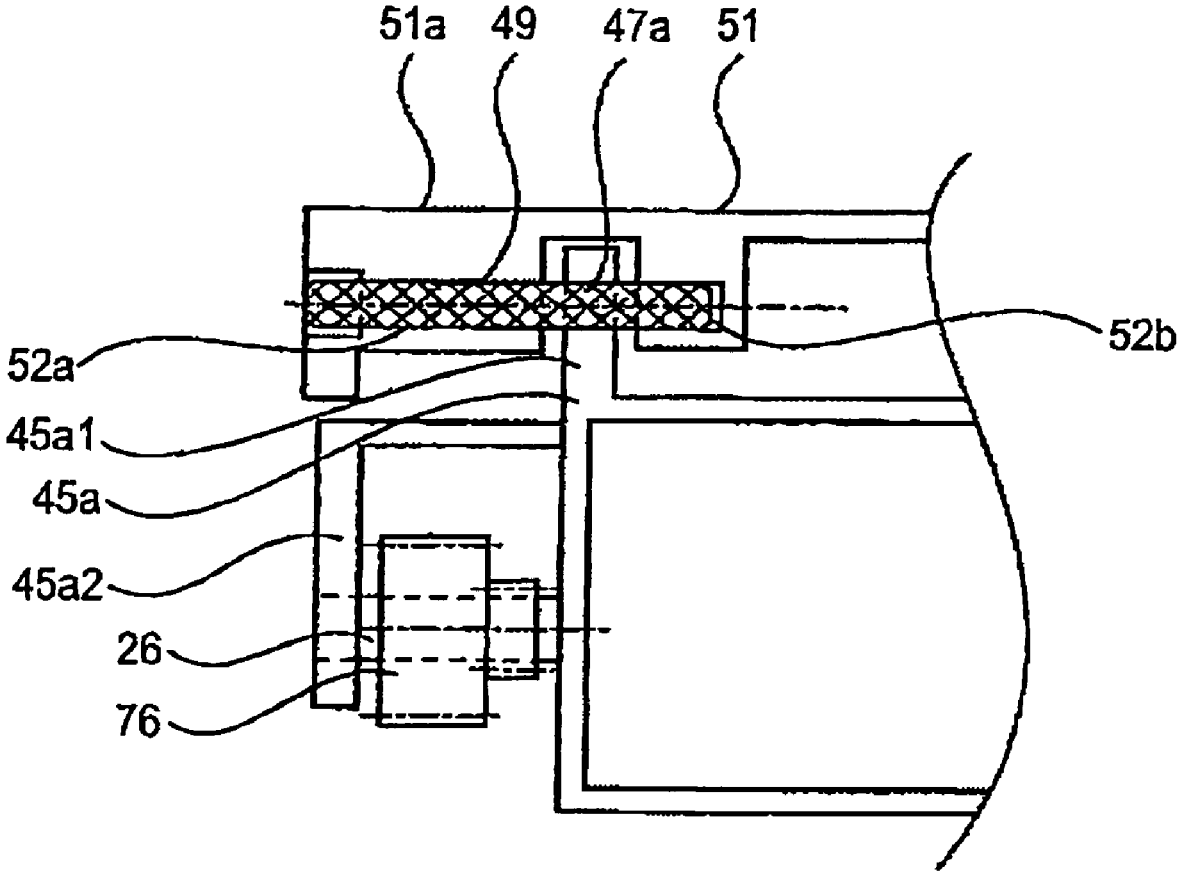
FIG. 9 is a sectional view of a process cartridge according to an embodiment of the present invention.
Figure 10:
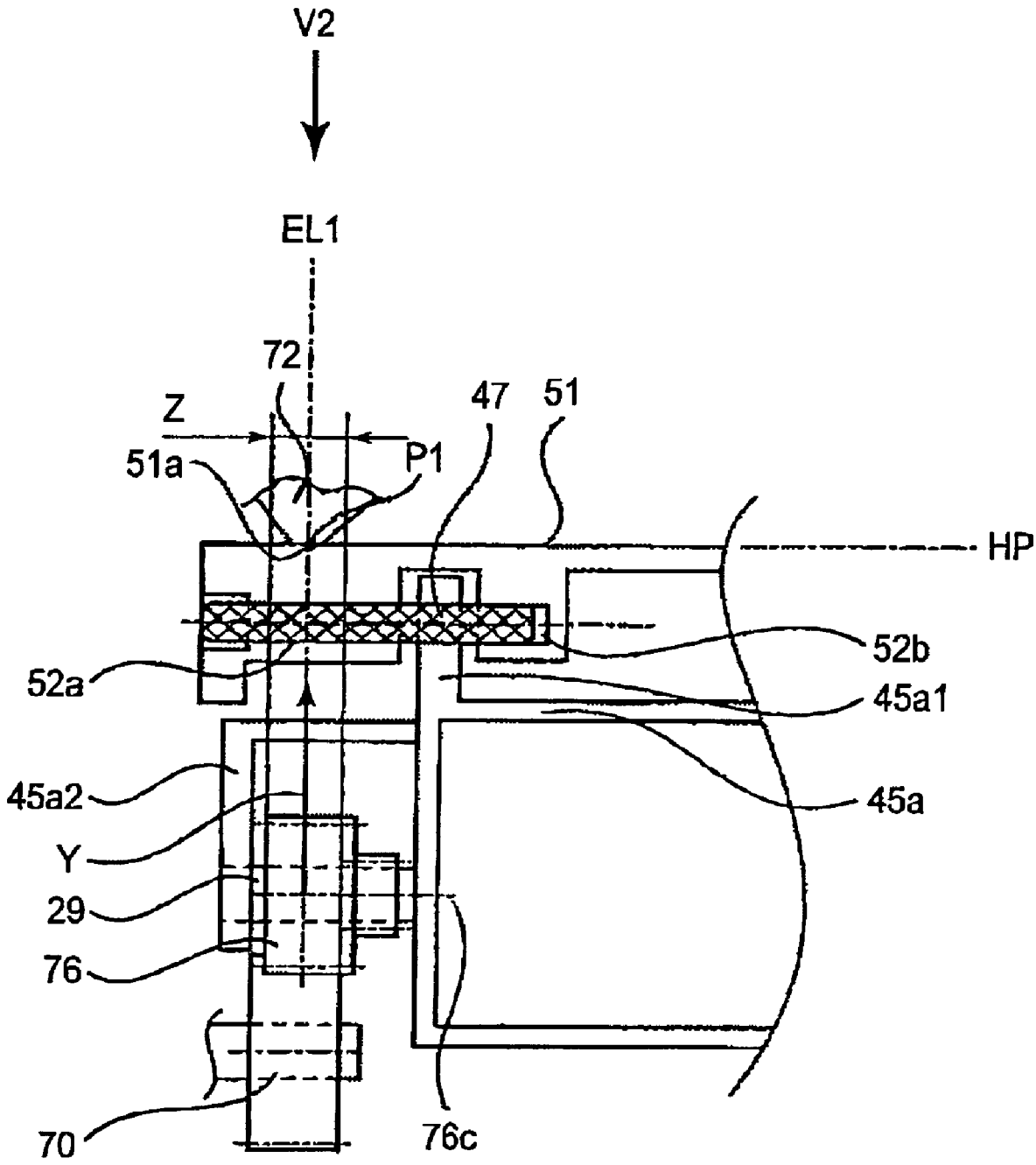
FIG. 10 is a sectional view of a process cartridge according to an embodiment of the present invention.

The developing unit 4, as shown in FIG. 8–FIG. 10, is supported rotatably on the cleaner unit 50. As shown in FIG. 8, one end of the developing device frame 45 is provided with an arm 45*a*1. The arm 45*a*1 is provided with a hole 47*a* which functions as an engaging portion. The cleaning frame 51 of the cleaner unit 50 is also provided at one end with a hole 52*a*. As shown in FIG. 9, a pin 49 (connecting member) having a circular section is penetrated through the holes 52*a*, 47*a*, 52*b* in this order, so that cleaning frame 51 and the developing device frame 45 are rotatably connected with each other.

Figure 14:
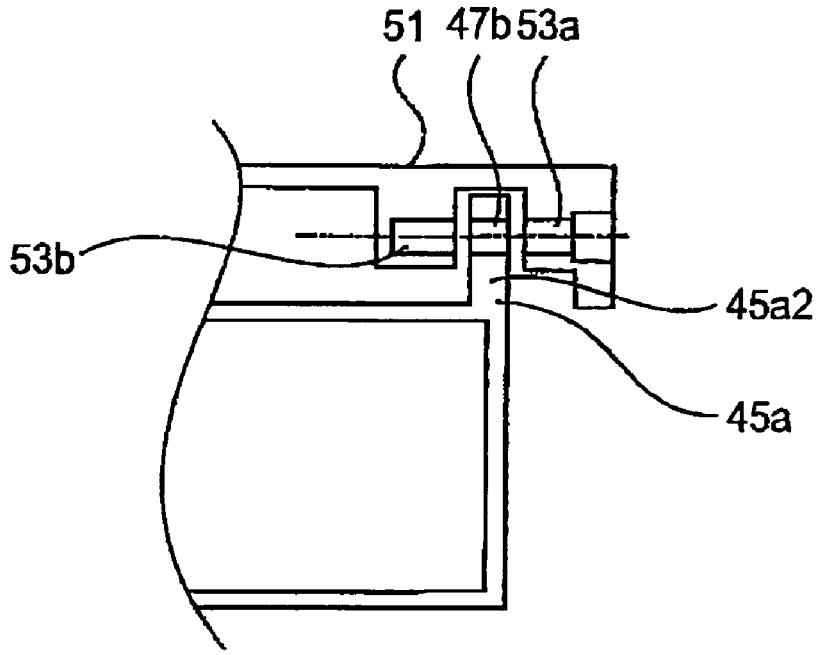
FIGS. 14(*a*) and 14(*b*) are sectional views of a process cartridge according to an embodiment of the present invention.
Figure 14:
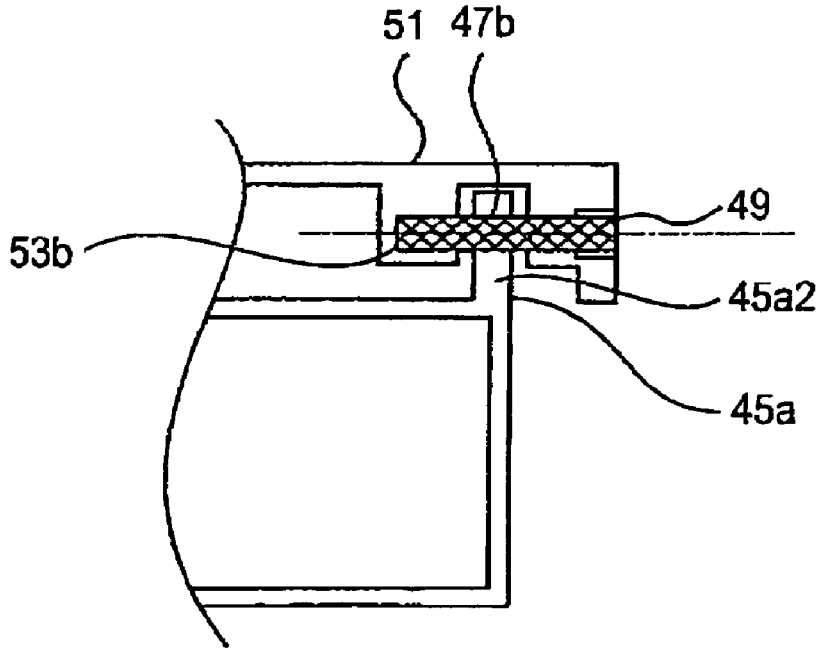

Similarly, as shown in FIGS. 14*a*, 14*b*, at the other side of the cartridge 7, a pin 49 is inserted through a hole 47*b* formed in other end of the developing device frame 45, the holes 53*a*, 53*b* formed in the other end of the cleaning frame 51. The developing unit 4 is normally urged by a pressing spring 22 so that the developing roller 40 is contacted to the photosensitive drum 1.

During the developing operation, the toner accommodated in the toner accommodating container 46 is fed to the toner supplying roller 43 by the toner stirring mechanism 42. The toner supplying roller 43 rotating in the direction indicated by an arrow D3 is in rubbing relation with the developing roller 40 rotating in the direction indicated by arrow D2, so that toner is supplied to the developing roller 40 to deposit the toner on the peripheral surface of the developing roller 40. The toner deposited and carried on the peripheral surface of the developing roller 40 is moved to the developing blade 44 with the rotation of the developing roller 40. The developing blade 44 regulates the toner to form a predetermined thin toner layer while applying a desired amount of the charge to the toner. The thin layer of the toner thus provided on the developing roller 40 is fed to the developing zone where the developing roller 40 is close to the photosensitive drum 1. The toner is deposited onto the electrostatic latent image formed on the surface of the photosensitive drum 1 by a developing bias applied to the developing roller 40 from a voltage source (unshown) in the developing zone, thus forming a developed image.

The toner not used for the development and remaining on the surface of the developing roller 40 is returned into the developing device with the rotation of the developing roller 40. The toner is removed from the developing roller 40 at the sliding portion which the developing roller 40 is in sliding relation with the toner supplying roller 43 and is collected. The collected toner is stirred and mixed with the other toner by the toner stirring mechanism.

(Mounting and Demounting of the Process Cartridge Relative to the Main Assembly of the Image Forming Apparatus)

Figure 4:
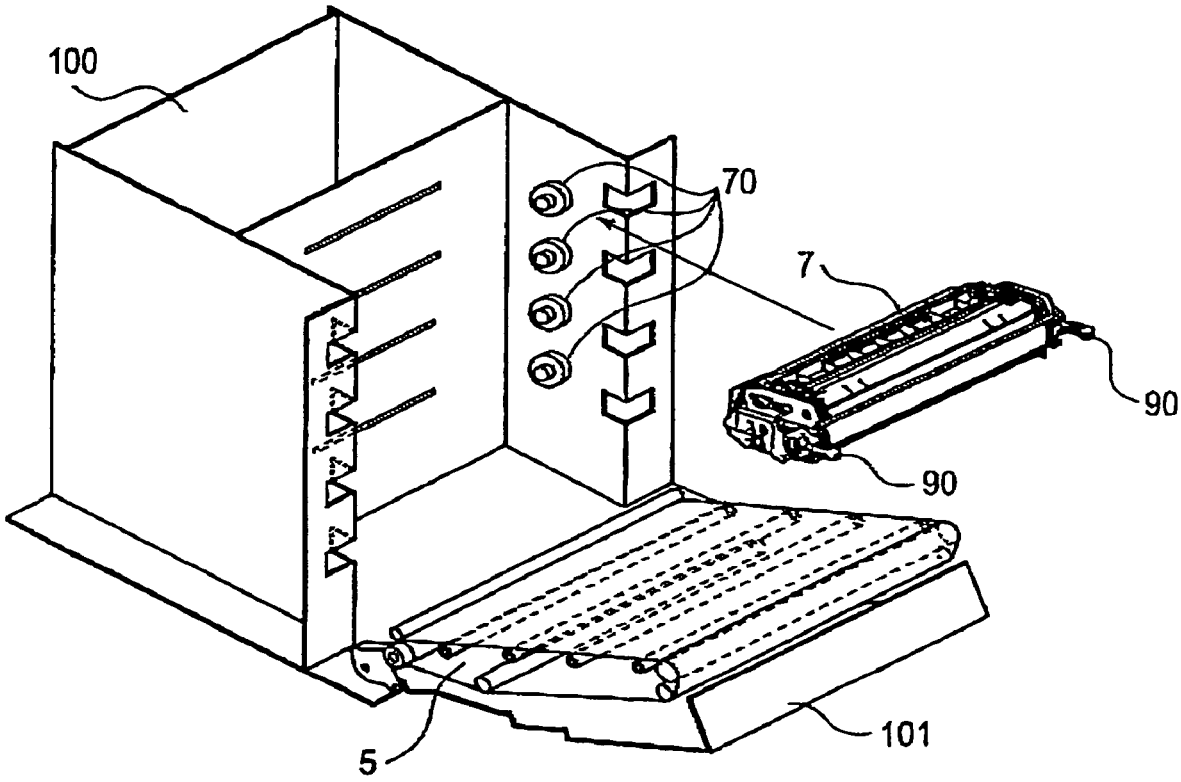
FIG. 4 is a schematic perspective view of the main assembly of the image forming apparatus in which the process cartridge is mounted thereto according to an embodiment of the present invention.

Referring to FIG. 4, a description will be provided as to the mounting and demounting method of the cartridge 7 relative to the main assembly 100 of the image forming apparatus. As shown in FIG. 4, the main assembly 100 of the image forming apparatus is provided with a front door 101 which is rotatable relative to the main assembly 100. On the front door 101, the electrostatic transferring means 5 is rotatably supported. When the front door 101 is opening, the cartridge 7 is capable of being mounted and demounted relative to the main assembly 100 of the image forming apparatus. Adjacent the photosensitive drum supporting portion at the respective ends of the cartridge 7, there are provided grip members 90 which facilitate the mounting and demounting of the cartridge 7. The cartridge 7 is mounted to the main assembly 100 of the image forming apparatus while engaging a guide portion (unshown) of the cartridge 7 on a guiding rail portion (unshown) provided in the main assembly 100 of the image forming apparatus.

(Positioning of Process Cartridge)

Figure 5:
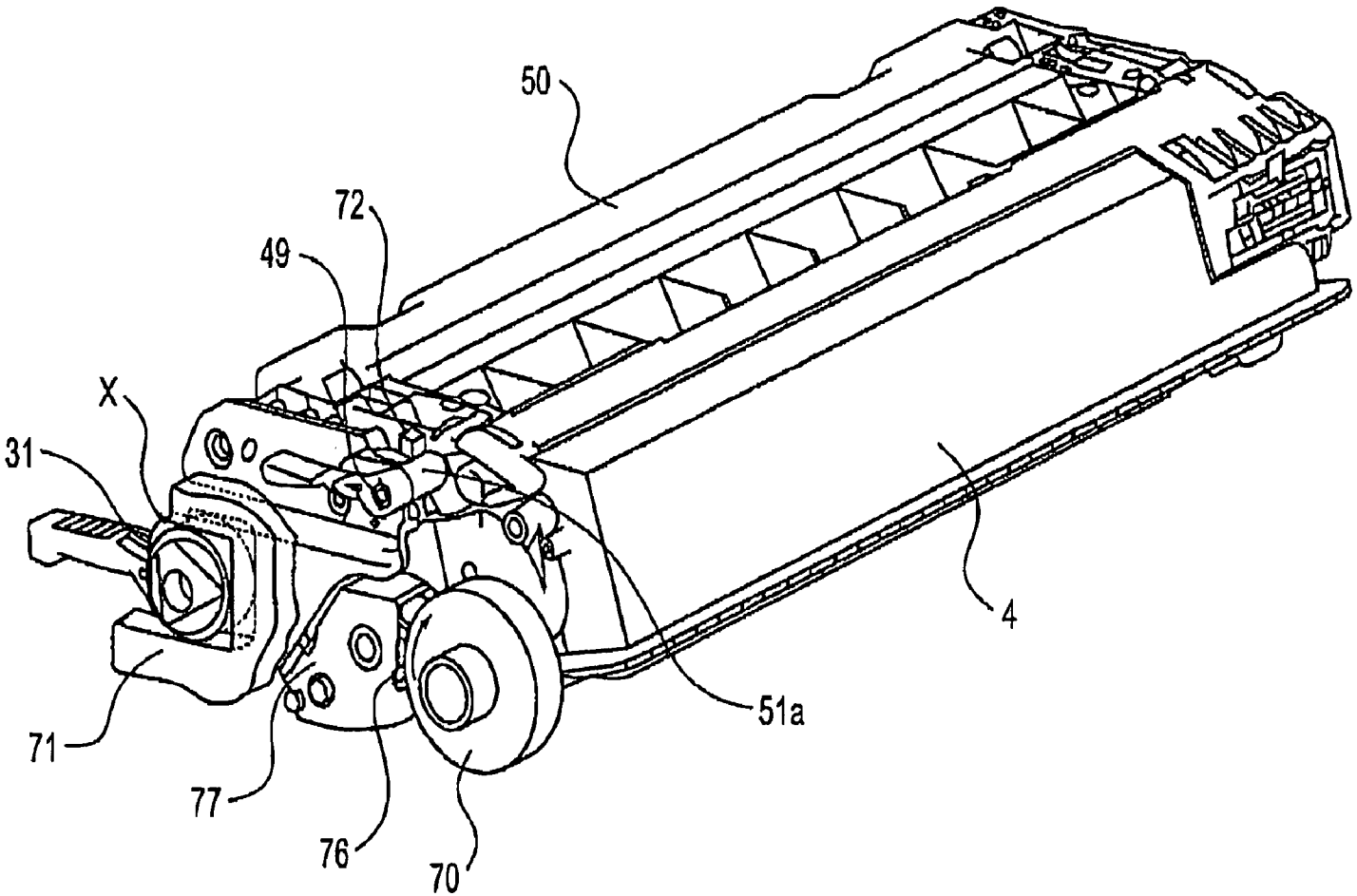
FIG. 5 is a perspective view of a process cartridge according to an embodiment of the present intention.
Figure 6:
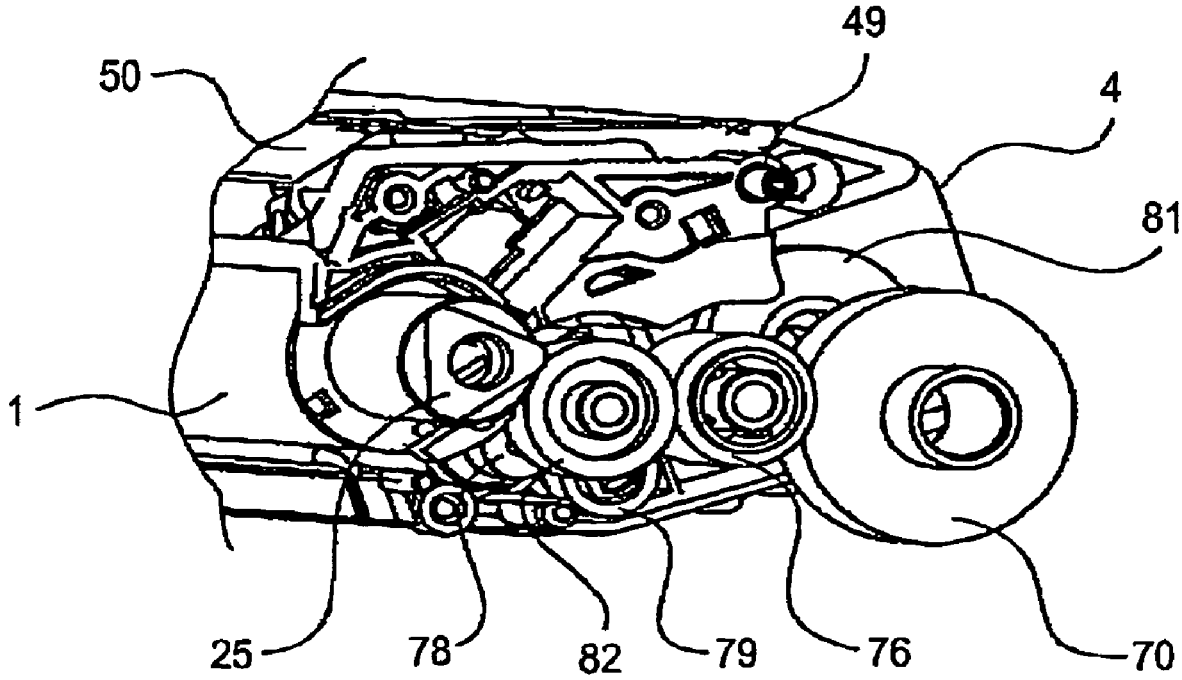
FIG. 6 is a perspective view of a process cartridge according to an embodiment of the present invention.
Figure 7:
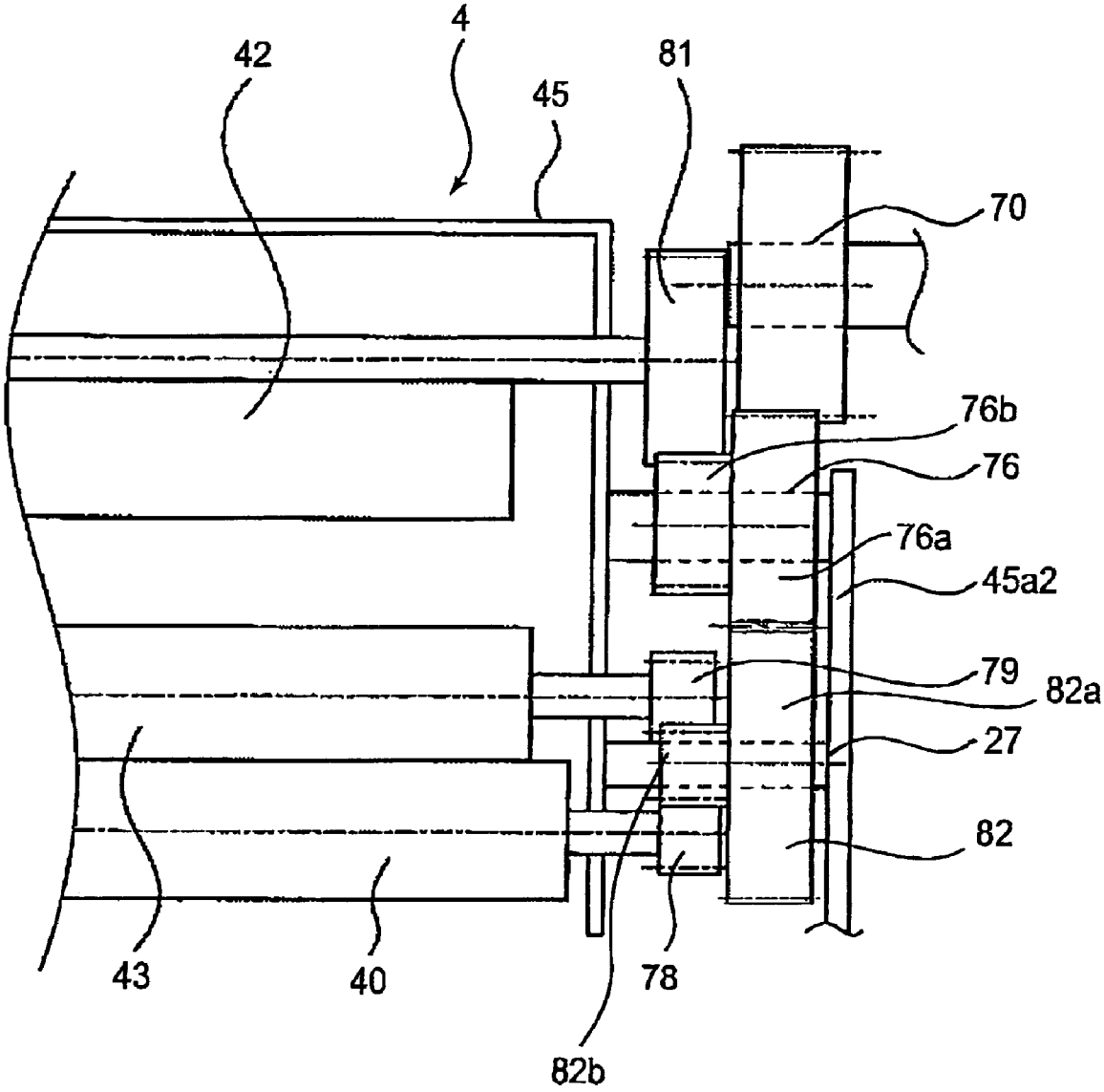
FIG. 7 is a sectional view of a drive transmission path according to an embodiment of the present invention.

As shown in FIGS. 5–7, the driving input gear 76 provided in the developing unit is engaged with the driving gear 70 provided in the main assembly 100 of the image forming apparatus to transmit the driving force. The driving force received by the driving input gear 76 is transmitted to the developing roller 40, the toner supplying roller 43, and the toner feeding mechanism 42 in the developing unit 4. By doing so, the developing roller 40, the toner supplying roller 43 and the toner feeding mechanism 42 are rotated. Referring to FIGS. 6, and 7, a description will be provided as to the driving force transmission path. The driving input gear 76 for receiving the rotational driving force from the driving gear 70 has two gears 76*a* and 76*b* which are coaxial. The driving input gear 76 is rotatably supported on a supporting shaft 26. One end of the supporting shaft 26 is supported on the developing device frame 45. The other end of the supporting shaft 26 is supported on the supporting portion 45*a*2. Furthermore, the developing device frame 45 supports by a supporting shaft 27 an idler gear 82 which receives the driving force from the driving input gear 76. The idler gear 82 has two coaxial gears 82*a* and 82*b*. The gear 76*b* is in meshing engagement with a toner feeding mechanism gear 81 for rotating the toner feeding mechanism 42 to transmit the rotational driving force. The gear 76*a* is in meshing engagement with the gear 82*a* to transmit the rotational driving force to the idler gear 82. In addition, the gear 82*b* is engaged with a toner supplying roller gear 79 for rotating the toner supplying roller 43 and a developing roller gear 78 for rotating the developing roller 40 to transmit the driving force to the developing roller 40.

Figure 11:
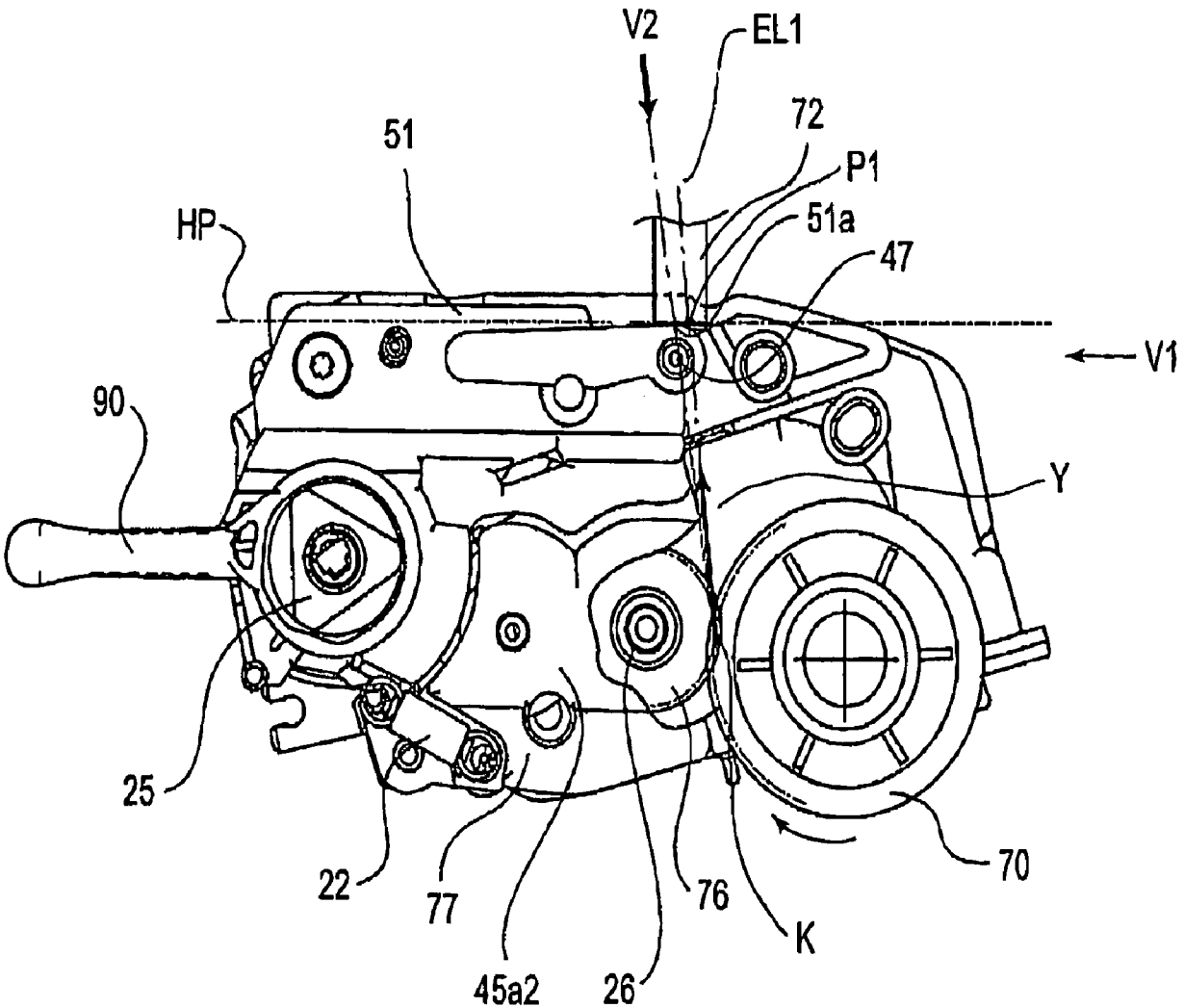
FIG. 11 is a side view of a process cartridge according to an embodiment of the present invention.

Thus, the rotational driving force from the driving gear 70 rotates the developing roller 40, the toner supplying roller 43 and the toner feeding mechanism 42, and the torque required for rotating them all is quite large. Therefore, as shown in FIG. 11, the input gear 76 receives a force Y corresponding to the torque at the engaging portion K between the driving gear 70 and the driving input gear 76.

Referring to FIGS. 5, and 10, a description will be provided as to the structure by which the cleaner unit 50 supporting the developing unit 4 which receives the force Y is supported by the main assembly 100 of the image forming apparatus. The cleaner unit 50 rotatably supporting the developing unit 4 is abutted against a supporting portion 71 of the main assembly 100 with a support force X from the main assembly 100 of the image forming apparatus at the outer periphery of the bearing member 31 (first positioning portion) which functions to rotatably support the photosensitive drum 1. The structure is the same at the other end with respect to axial direction of the photosensitive drum 1. With this structure, the cartridge 7 can be correctly positioned with respect to a direction crossing with longitudinal direction of the cartridge 7. As shown in FIGS. 5 and 11, the cartridge 7 receives the force Y at the driving input gear 76 by the rotational driving force from the driving gear 70, as described hereinbefore. Therefore, the cartridge 7 receives a force tending to rotate about the bearing member 31, and a positioning portion 51*a* of the cleaning frame 51 is abutted to a supporting portion 72 provided in the main assembly 100 of the image forming apparatus. In other words, the rotation of the cartridge 7 about the bearing member 31 is limited by the second supporting portion 72. By doing so, the cartridge 7 is positioned in place relative to the main assembly 100 of the apparatus.

Figure 15:
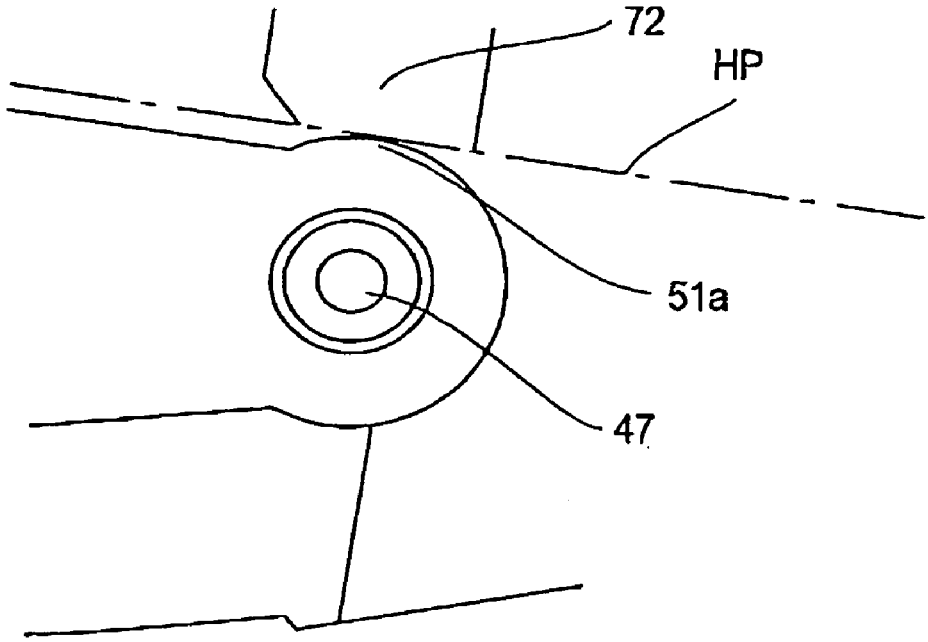
FIGS. 15(*a*) and 15(*b*) are sectional views of a process cartridge according to an embodiment of the present invention.
Figure 15:
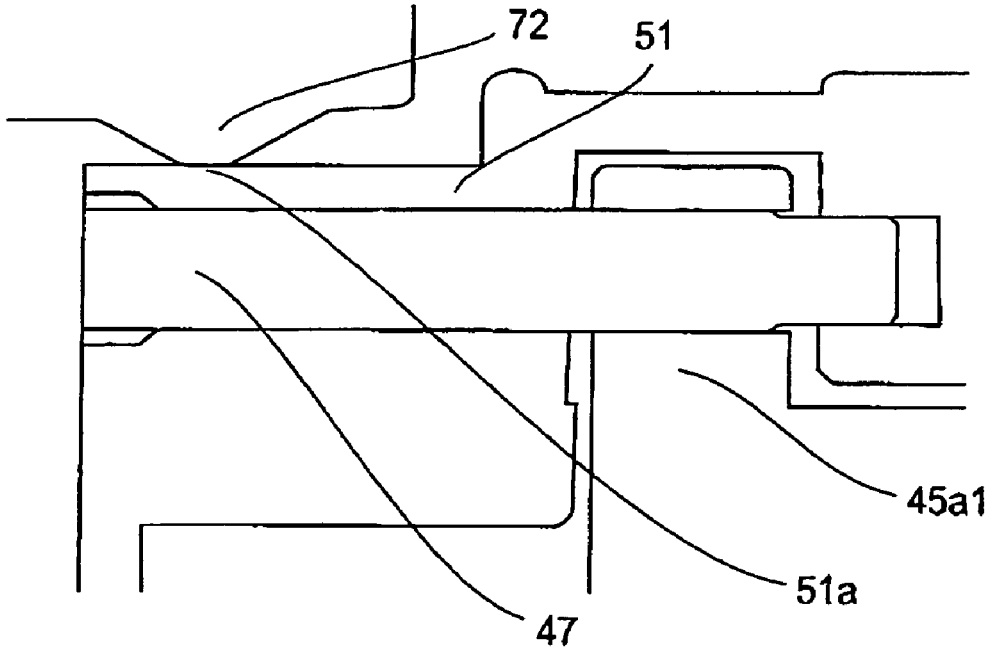

FIG. 15 (*a*) is a detailed illustration of the supporting portion 72 and the second cartridge positioning portion 51*a* as seen in the longitudinal direction of the cartridge 7 (a direction of the axis of the photosensitive drum 1). FIG. 15 (*b*) is a detailed illustration of the second supporting portion 72 and the cartridge positioning portion 51*a* as seen in a direction perpendicular to the longitudinal direction of the cartridge 7 (the direction of the axis of the photosensitive drum 1). The supporting portion 72 has a flat surface configuration to provides a reference surface HP. The cartridge 7 is positioned by abutting the supporting portion 72 at the cartridge positioning portion 51*a*.

(Positional Relation Between the Driving Input Gear and Positioning Portion)

FIGS. 10, and 11 show a positional relation between driving input gear 76 and the positioning portion 51*a*. FIG. 10 is a view as seen in the direction V1 in FIG. 11. The direction V1 is parallel with the reference surface HP. As will be understood from these figures, when the cartridge 7 is seen in the direction V1, the positioning portion 51*a* is included in an engagement width (engagement range) Z between the driving input gear 76 and the driving gear 70 with respect to the direction perpendicular to the longitudinal direction of the cartridge 7. Then, the relation between the positioning portion 51*a* and the force Y is as follows. As shown in FIG. 11, the force Y is expressed as a vector having a starting point at the engaging portion K between the driving input gear 76 and the driving gear 70 and having an orientation which is upward when the cartridge 7 is mounted to the main assembly 100 of the image forming apparatus. An extension line ELI of the force Y intersects the reference surface HP at point P1. In the longitudinal direction of the cartridge 7, the positional relation of the force Y and the positioning portion 51*a* is as shown in FIG. 10. The force Y is a vector having a starting point at a center of the engagement range Z (a point Z/2 away from the end of the driving input gear 76) between the driving input gear 76 and the driving gear 70. An extension line ELI of the force Y is at such a position overlapping with the positioning portion 51*a* with respect to the direction perpendicular to the longitudinal direction of the cartridge 7 as seen in the direction V1.

In other words, the positional relation between the driving input gear 76 and the positioning portion 51*a* is as follows. As shown in FIGS. 10, 11, the engagement range Z in the longitudinal direction is seen in a direction which is perpendicular to the longitudinal direction and which passes through the second cartridge positioning portion 51*a*. Then, engagement range Z is at a position overlapping with the second cartridge positioning portion 51*a*.

Further, the positional relation is described as follows. The longitudinal engagement range Z shown in FIGS. 10 and 11 is projected on the axis 76*c* of the driving input gear 76. When the projected range (projection range) is seen in a direction (unshown) which is perpendicular to the longitudinal direction and which passes through the cartridge positioning portion 51*a*, the projection range overlaps the cartridge positioning portion 51*a*.

Furthermore, the driving input gear 76, as seen in the direction V1, overlaps at least a part of the positioning portion 51*a*, with respect to the longitudinal direction of the cartridge 7.

With this structure, even when the cartridge 7 receives the rotational driving force at the driving gear 70, the cleaning frame 51 is not subjected to a moment about the positioning portion 51*a*, as shown in FIG. 10. Therefore, a deformation of the cleaning frame 51 is suppressed, so that the cartridge 7 can be properly positioned relative to the main assembly 100 of the apparatus. Thus, the deformation of the developing device frame 45 supported rotatably to the cleaning frame 51 can be suppressed.

In this manner, the positioning accuracies of the developing roller 40 and the toner supplying roller 43 relative to the photosensitive drum 1 is improved. This is effective to improve the image quality of the image provided by the apparatus. In addition, the positioning accuracy of the cleaning blade 60 supported on the cleaning frame 51 relative to the photosensitive drum 1 is improved, so that the removal property of the residual toner from the surface of the photosensitive drum 1 improved.

In this embodiment, as described hereinbefore, the cartridge positioning portion 51*a* is included in the engagement range Z with respect to the direction perpendicular to the longitudinal direction of the cartridge 7. However, only a part of the positioning portion 51*a* may overlap the engagement width Z. On the contrary, the width of the positioning portion 51*a* may be larger than the engagement width Z.

In the case that driving input gear 76 is a helical gear, the force Y is inclined correspondingly to the angle of twist of the gear teeth. However, when considering the deformation of the cleaning frame 51 by the moment about the positioning portion 51*a*, it will suffice if the component in the direction perpendicular to the supporting portion 72 (reference surface HP) is considered. That is, it is sufficient that component in the direction of the force Y shown FIG. 10 is considered.

The positioning portion 51*a* is disposed above the driving input gear 76 when the cartridge 7 is set in place in the main assembly 100 of the apparatus. With this structure, the driving gear 70 and the second supporting portion 72 can be at different positions in the main assembly 100 of the apparatus, the main assembly 100 of the apparatus can be downsized, and the cartridge 7 can be downsized.

Moreover, the positioning portion 51*a* is provided by the peripheral surface of a cylindrical projection which is coaxial with the supporting hole supporting the pin 49. The projected portion is projected from the cleaning frame 51. The pin 49 is supported inside the projected portion. With this feature, the main assembly 100 of the apparatus can be downsized, and the cartridge 7 can be downsized.

The second cartridge positioning portion 51*a* may be provided only at one end side of the cartridge 7 with respect to the longitudinal direction. With the above-described positional relation between the engagement range Z and the cartridge positioning portion 51*a*, the deformation of the cleaning frame 51 can be suppressed, and the cartridge 7 can be correctly positioned to the main assembly 100 of the apparatus, even if the cartridge positioning portion is not provided at the other longitudinal end. This eliminates the necessity of the space for providing the positioning structure at the other side, so that the main assembly 100 of the apparatus and the cartridge 7 can be downsized. This advantage is significant particularly when the cartridges 7 are arranged substantially in the vertical direction in the main assembly of the multi-color image forming apparatus 100 as in this embodiment.

(Checking)

Figure 13:
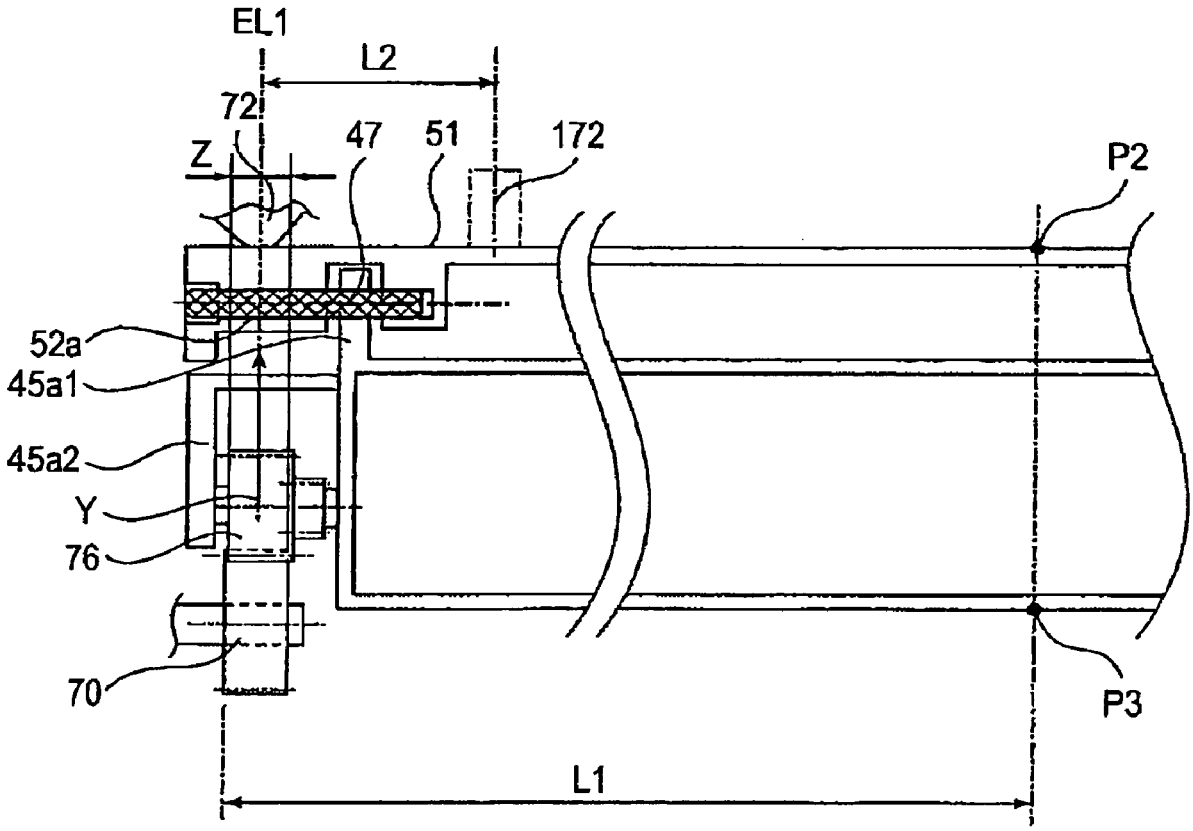
FIG. 13 is a sectional view of a process cartridge according to an embodiment of the present invention.

FIG. 13 illustrates a checking method for the deformation of the cartridge 7. For example, a deformation amount of the cleaning frame at a position predetermined distance L1 away from an end of the driving gear 70 (reference point), which is displaced from a reference surface HP at the point P2, or a deformation amount of the developing device frame (a displacement from the reference plane HP at point P3), are measured. More particularly, the deformations are compared with deformations which are measured when the supporting portion 172 is at a position L2 away from the point ELI. By doing so, the effect of the embodiment can be confirmed. The measurements may be carried out using a dial gauge.

Second Embodiment

Figure 12:
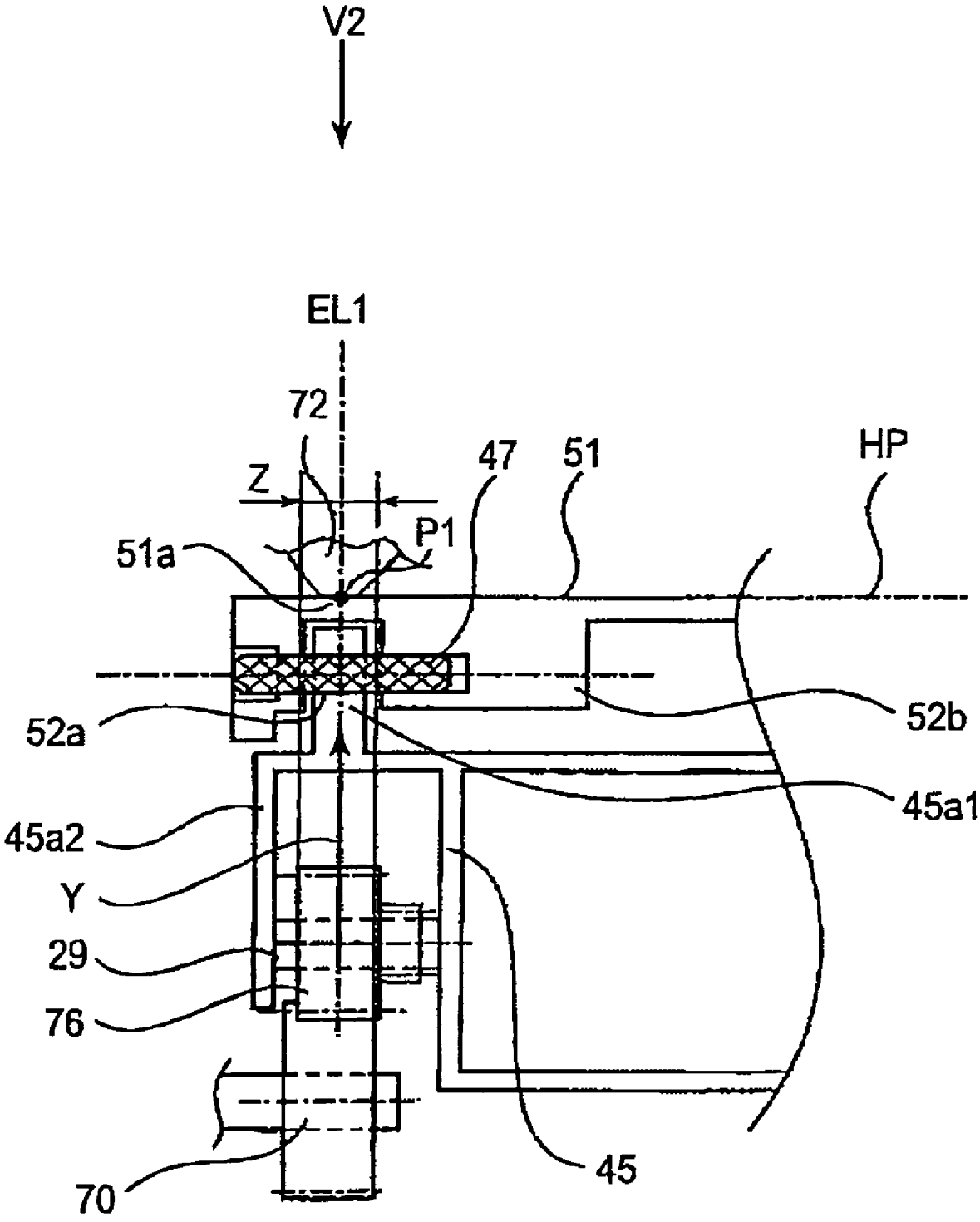
FIG. 12 is a sectional view of a process cartridge according to an embodiment of the present invention.

The mounting structure of the developing device is frame 45 relative to the cleaning frame 51 may be as shown in FIG. 12. Here, a position, in the longitudinal direction of the cartridge 7, of an arm 45*a*1 having the hole 52*a* for penetration of the pin 47 is seen in the direction which is perpendicular to the longitudinal direction of the cartridge 7 and which passes through the cartridge positioning portion 51*a* (direction V3 in FIGS. 11 and 12). Then, the arm 45*a*1 which is an engaging portion relative to the pin 47 is at a position overlapping with the second cartridge positioning portion 51*a*.

When they are seen in the direction V1 in FIG. 11, the structure is as follows. Namely, the position of the arm 45*a*1 having the hole 52*a* for penetration of the pin 47 overlaps with an extension line ELI of the force Y received by the driving input gear 76 with respect to the longitudinal direction of the cartridge 7. Similarly, to the structure in FIG. 10, an extension ELI of the force Y also overlaps positioning portion 51*a* with respect to the longitudinal direction, as seen in the direction V1.

With this structure, the cleaning frame 51 is not subjected to a moment about positioning portion 51*a*. The deformation of the developing device frame on the cleaning frame 51 can be suppressed, and therefore, the positioning accuracies of the developing roller 40 and the toner supplying roller 43 relative to the photosensitive drum 1 can be improved, so that image quality can be improved. The positioning accuracy of the cleaning blade 60 supported on the direction relative to the photosensitive drum 1 can be improved, so that the removal property of the residual toner from the photosensitive drum 1 can be improved, too. In addition, the cartridge 7 and the main assembly 100 of the apparatus can be downsized.

In the first and second embodiments, the material of the cleaning frame 51 and the developing device frame 45 is a styrene material, such as high impact polystyrene (HIPS), acrylic nytril butadiene polymer (ABS) or the like. From the standpoint of moldability and the cost, the thicknesses of the cleaning frame 51 and the developing device frame 45 are small. However, in order to assure the mechanical strength of the frame, a certain degree of thickness (approx. 2 mm) is required even when such a material is used. According to the present invention, the thickness can be reduced (for example, to degree 1.5 mm). In some cases, in order to reinforce the frame, a metal plate has been used at an upper part of the cartridge. However, according to the present invention, there is no need to use such a metal plate. This accomplishes cost reduction, downsizing, lightening, and better assembling properties.

As described in the foregoing, according to the present invention, the deformation of the developing cartridge or the process cartridge is suppressed when the rotational driving force is transmitted from the main assembly of the electrophotographic image forming apparatus. The positional accuracy of the developing roller is improved when the rotational driving force is transmitted from the main assembly of the electrophotographic image forming apparatus in the developing cartridge, the process cartridge and the electrophotographic image forming apparatus. In addition, the developing cartridge, the process cartridge and the electrophotographic image forming apparatus can be downsized.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 293846/2004 filed Oct. 6, 2004, which is hereby incorporated by reference.

The invention claimed is:

1. A process cartridge detachably mountable to an electrophotographic image forming apparatus, said process cartridge comprising:

an electrophotographic photosensitive drum extending in a longitudinal direction of said process cartridge;

a cartridge coupling, provided at one longitudinal end of said photosensitive drum, configured and positioned to engage a main assembly coupling provided in a main assembly of the apparatus to transmit a driving force from a motor provided in the main assembly of the apparatus to said photosensitive drum when said process cartridge is mounted to the main assembly of the apparatus:

a developing roller configured and positioned to develop an electrostatic latent image formed on said electrophotographic photosensitive drum;

a first cartridge positioning portion which is provided at each of one and the other longitudinal end portion of said process cartridge and which is abuttable to a first main assembly positioning portion provided in the main assembly of the apparatus to position said process cartridge with respect to a direction crossing the longitudinal direction, when said process cartridge is mounted to the main assembly of the apparatus;

a second cartridge positioning portion which is provided at one longitudinal end portion of said process cartridge and which is abuttable to a second main assembly positioning portion provided in the main assembly of the apparatus to limit rotation of said process cartridge about said first cartridge positioning portion, when said process cartridge receives a rotational driving force for rotating said developing roller from the main assembly of the apparatus; and a first drive input gear, provided at said one longitudinal end portion, for engagement with a main assembly driving gear provided in the main assembly to transmit a rotational driving force to said developing roller, wherein a range of engagement, with respect to the longitudinal direction, between the main assembly driving gear and said first drive input gear when said first drive input gear is engaged with the main assembly driving gear, overlaps with said second cartridge positioning portion as seen in a direction which is perpendicular to the longitudinal direction and which passes through said second cartridge positioning portion.

2. A process cartridge according to claim 1, further comprising:

a first frame supporting said electrophotographic photosensitive drum;

a second frame supporting said developing roller; and a coupling member for configured and positioned to rotatably connect said first frame and said second frame, wherein said first cartridge positioning portion and said second cartridge positioning portion are provided in said first frame.

3. A process cartridge according to claim 2, wherein an abuttable portion of one of said first and second cartridge positioning portions abuttable to one of said first and second main assembly positioning portions is a peripheral surface of a cylindrical projection.

4. A process cartridge according to claim 3, wherein an inside of said cylindrical projection supports said coupling member.

5. A process cartridge according to claim 2, wherein said coupling member overlaps at least partly said second cartridge positioning portion as seen in a direction perpendicular to the longitudinal direction.

6. A process cartridge according to claim 1, wherein said second cartridge positioning portion is provided only at said one longitudinal end portion.

7. A process cartridge according to claim 2, further comprising a cleaning blade, provided in said first frame, configured and positioned to remove a developer from a peripheral surface of said electrophotographic photosensitive drum.

8. A process cartridge according to claim 2, wherein said second cartridge positioning portion is disposed above said coupling member in a state in which said process cartridge is set in the main assembly of the apparatus.

9. A process cartridge according to claim 2, wherein said first drive input gear is provided in said second frame.

10. A process cartridge according to claim 6, wherein said second frame includes an engaging portion engaged with said coupling member, and said engaging portion overlaps with said second cartridge positioning portion as seen in a direction which is perpendicular to the longitudinal direction and which passes through said second cartridge positioning portion.

11. A process cartridge according to claim 1, further comprising:

a developer accommodating portion accommodating a developer to be used by said developing roller to develop the electrostatic latent image;

a developer feeding member, provided in said developer accommodating portion, configured and positioned to feed the developer toward said developing roller; and a developer supplying roller configured and positioned to supply the developer to said developing roller to carry the developer on the developing roller, and wherein said first drive input gear transmits the rotational driving force to said developing roller and also transmits the driving force to said developer feeding member and to said developer supplying roller.

12. A process cartridge according to claim 1, wherein said second cartridge positioning portion is disposed above said first drive input gear in a state in which said process cartridge is set in the main assembly of the apparatus.

13. An electrophotographic image forming apparatus for forming an image on a recording material, to which a process cartridge is detachably mountable, said apparatus comprising:

(a) a first main assembly positioning portion provided in a main assembly of said apparatus;

(b) a second main assembly positioning portion provided in the main assembly of said apparatus;

(c) a motor provided in the main assembly of said apparatus:

(d) a main assembly coupling provided in the main assembly of said apparatus:

(e) a main assembly driving gear provided in the main assembly of said apparatus;

(f) mounting means configured and positioned to detachably mount the process cartridge, the process cartridge including:

an electrophotographic photosensitive drum extending in a longitudinal direction of the process cartridge;

a cartridge coupling, provided at one longitudinal end of the photosensitive drum, configured and positioned to engage said main assembly coupling to transmit a driving force from said motor to the photosensitive drum when the process cartridge is mounted to the main assembly of the apparatus;

a developing roller configured and positioned to develop an electrostatic latent image formed on the electrophotographic photosensitive drum;

a first cartridge positioning portion which is provided at each of one and the other longitudinal end portion of the process cartridge and which is abuttable to said first main assembly positioning portion to position the process cartridge with respect to a direction crossing the longitudinal direction, when the process cartridge is mounted to the main assembly of said apparatus;

a second cartridge positioning portion which is provided at one longitudinal end portion of the process cartridge and which is abuttable to said second main assembly positioning portion to limit rotation of the process cartridge about the first cartridge positioning portion, when the process cartridge receives a rotational driving force for rotating the developing roller from the main assembly of said apparatus; and a first drive input gear, provided at said one longitudinal end portion, configured and positioned to engage with said main assembly driving gear to transmit a rotational driving force to the developing roller, wherein a range of engagement, with respect to the longitudinal direction, between said main assembly driving gear and the first drive input gear when the first drive input gear is engaged with said main assembly driving gear, overlaps with the second cartridge positioning portion as seen in a direction which is perpendicular to the longitudinal direction and which passes through the second cartridge positioning portion; and (g) feeding means for feeding the recording material.

* * * * *

UNITED STATES PATENT AND TRADEMARK OFFICE

CERTIFICATE OF CORRECTION

PATENT NO. : 7,212,768 B2
APPLICATION NO. : 10/960088
DATED : May 1, 2007
INVENTOR(S) : Atsushi Numagami et al.

It is certified that error appears in the above-identified patent and that said Letters Patent is hereby corrected as shown below:

COLUMN 1
Line 42, “is material.” should read --material.--.

COLUMN 2
Line 56, “roller” should read --roller;--.
Line 67, “mountable,” should read --mountable.--.

COLUMN 3
Line 58, “intention.” should read --invention.--.

COLUMN 7
Line 42, “in other” should read --in the other--.

COLUMN 9
Line 1, “FIGS. 5,” should read --FIGS. 5--.
Line 37, “to provides” should read --to provide--.
Line 43, “FIGS. 10,” should read --FIGS. 10--.
Line 59, “ELI” should read --EL1--.
Line 66, “ELI” should read --EL1--.

COLUMN 10
Line 41, “improved.” should read --is improved--.
Line 56, “component” should read --the component--; and “shown” should read --shown in--.

COLUMN 11
Line 31, “ELI” should read --EL1--.
Line 38, “may be” should read --and may be--.
Line 51, “ELI” should read --EL1--.
Line 55, “ELI” should read --EL1--.

COLUMN 12
Line 54, “apparatus:” should read --apparatus;--.

COLUMN 13
Line 27, “for” should be deleted.

UNITED STATES PATENT AND TRADEMARK OFFICE

CERTIFICATE OF CORRECTION

PATENT NO. : 7,212,768 B2
APPLICATION NO. : 10/960088
DATED : May 1, 2007
INVENTOR(S) : Atsushi Numagami et al.

It is certified that error appears in the above-identified patent and that said Letters Patent is hereby corrected as shown below:

COLUMN 14
Line 29, "apparatus:" should read --apparatus;--.
Line 31, "apparatus:" should read --apparatus;--.

Signed and Sealed this

Twenty-sixth Day of August, 2008

JON W. DUDAS
*Director of the United States Patent and Trademark Office*